US010665991B2

(12) United States Patent
Li et al.

(10) Patent No.: US 10,665,991 B2
(45) Date of Patent: May 26, 2020

(54) ELECTRICAL CONNECTOR WITH A LOCKING STRUCTURE

(71) Applicant: Tyco Electronics (Shanghai) Co. Ltd., Shanghai (CN)

(72) Inventors: Xian Li, Shenzhen (CN); Xinjie Zhang, Kunshan (CN); Xin Song, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/106,089

(22) Filed: Aug. 21, 2018

(65) Prior Publication Data

US 2019/0058287 A1 Feb. 21, 2019

(30) Foreign Application Priority Data

Aug. 21, 2017 (CN) ..... 2017 1 0720804

(51) Int. Cl.

| | |
|---|---|
| ***H01R 13/633*** | (2006.01) |
| ***H01R 13/627*** | (2006.01) |
| ***H01R 13/506*** | (2006.01) |
| ***H01R 13/504*** | (2006.01) |
| *H01R 12/70* | (2011.01) |

(52) U.S. Cl.

CPC ..... *H01R 13/6335* (2013.01); *H01R 13/504* (2013.01); *H01R 13/506* (2013.01); *H01R 13/6273* (2013.01); *H01R 13/6275* (2013.01); *H01R 12/7005* (2013.01)

(58) Field of Classification Search

CPC ..... H01R 13/6335; H01R 13/6275; H01R 12/7005; H01R 13/506; H01R 13/504; H01R 13/6271–6273; H01R 13/635

USPC ..... 439/352, 155, 357, 358

See application file for complete search history.

(56) References Cited

U.S. PATENT DOCUMENTS

| | | | | |
|---|---|---|---|---|
| 7,318,740 | B1 * | 1/2008 | Henry | H01R 13/6275 439/352 |
| 8,011,950 | B2 | 9/2011 | McGrath et al. | |
| 8,231,400 | B2 * | 7/2012 | Phillips | G02B 6/4201 439/357 |
| 8,475,198 | B2 * | 7/2013 | Wu | H01R 13/6275 439/352 |
| 8,506,319 | B2 * | 8/2013 | Ritter | H01R 13/6335 439/352 |
| 8,662,917 | B2 * | 3/2014 | Wang | H01R 9/038 439/493 |
| 8,770,990 | B2 * | 7/2014 | Sytsma | H01R 9/034 439/76.1 |

(Continued)

*Primary Examiner* — Travis S Chambers

(74) *Attorney, Agent, or Firm* — Barley Snyder

(57) ABSTRACT

An electrical connector comprises a housing, an electrical connection assembly received in the housing, and a locking mechanism mounted on an outer surface of the housing and configured to releasably lock the electrical connector and a mating electrical connector together. The locking mechanism includes a handle, a locking member adapted to be engaged with a locking structure on the mating electrical connector, the locking member connected to the handle such that the mating electrical connector is unlocked when the handle is pulled, and a fixing member mounted on the outer surface of the housing and adapted to position the locking member and the handle between the fixing member and the housing.

18 Claims, 20 Drawing Sheets

(56) References Cited

U.S. PATENT DOCUMENTS

| | | | | |
|---|---|---|---|---|
| 9,203,193 | B2 | 12/2015 | Hackman et al. | |
| 2019/0058275 | A1* | 2/2019 | Li | H01R 13/405 |

* cited by examiner

ELECTRICAL CONNECTOR WITH A LOCKING STRUCTURE

CROSS-REFERENCE TO RELATED APPLICATION

This application claims the benefit of the filing date under 35 U.S.C. § 119(a)-(d) of Chinese Patent Application No. 201710720804.2, filed on Aug. 21, 2017.

FIELD OF THE INVENTION

The present invention relates to an electrical connector and, more particularly, to an electrical connector capable of achieving a stable electrical connection and a compact structure.

BACKGROUND

A conventional casing of an electrical connector, such as the casing of a C form-factor 400 ("CDFP") electrical connector for a 400 GB/s high speed cable, generally includes die-cast molded metal housings which are fixedly connected by a connecting part. Such a casing is relatively large in volume and complex in assembly. For wires soldered to a circuit board and located inside the electrical connector, due to their flexibility, the wires are easily bent and displaced, resulting in the looseness of the wires and affecting the stability of the electrical connection.

In general, highly flexible cables have significant advantages in the case where electrical connectors are required to connect cables together and an interior space thereof is limited. Such highly flexible cables may be formed using a nylon cladding layer to clad a plurality of discrete wires, such as in 39P cables. The plurality of discrete wires are difficult to organize when soldered to the circuit board, and the wires easily interfere with each other. An existing solution is to separate and hold the plurality of wires using a wire clip, but an existing wire clip is relatively thick, bulky, and difficult to be accommodated in the housing of the electrical connector. Therefore, it is necessary to remove the wire clip after the wires are soldered to the circuit board, complicating the operation. Furthermore, there are continuous demands for reducing an occupied volume and improving the stability of the electrical connection in the field of electrical connectors.

SUMMARY

An electrical connector comprises a housing, an electrical connection assembly received in the housing, and a locking mechanism mounted on an outer surface of the housing and configured to releasably lock the electrical connector and a mating electrical connector together. The locking mechanism includes a handle, a locking member adapted to be engaged with a locking structure on the mating electrical connector, the locking member connected to the handle such that the mating electrical connector is unlocked when the handle is pulled, and a fixing member mounted on the outer surface of the housing and adapted to position the locking member and the handle between the fixing member and the housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
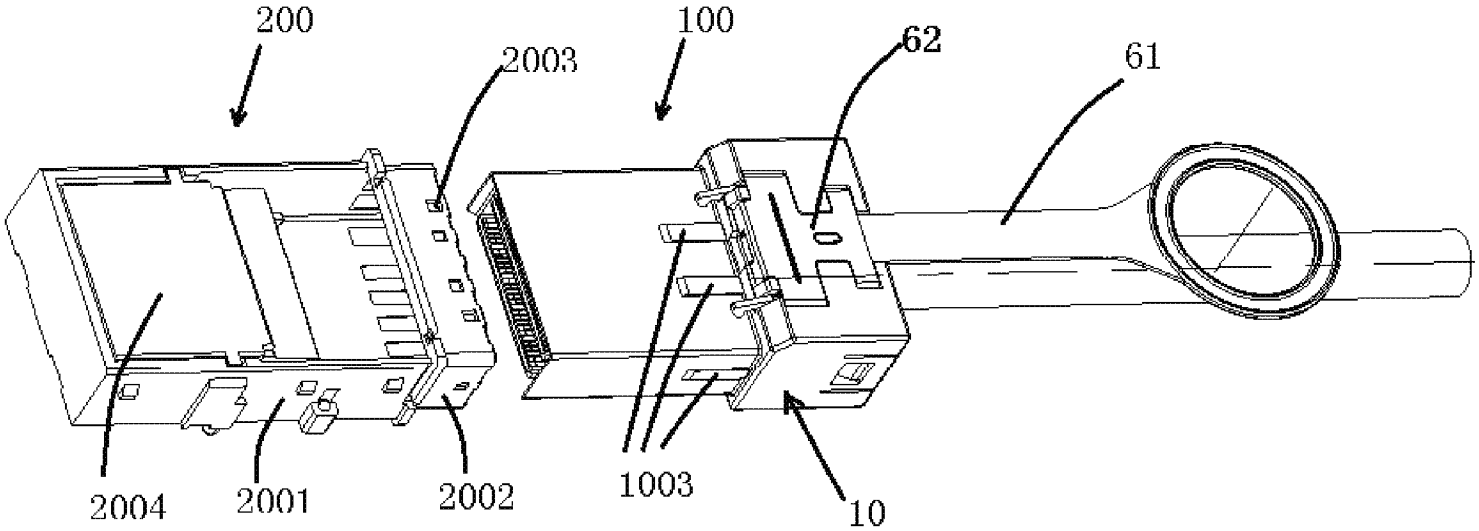
FIG. 1 is an exploded perspective view of an electrical connector and a mating electrical connector according to an embodiment.

The technical solution of the disclosure will be described hereinafter in further detail with reference to the following embodiments, taken in conjunction with the accompanying drawings. In the specification, the same or similar reference numerals indicate the same or similar parts. The description of the embodiments of the disclosure hereinafter with reference to the accompanying drawings is intended to explain the general inventive concept of the disclosure and should not be construed as a limitation on the disclosure.

An electrical connector 100 according to an embodiment is shown in FIGS. 1-13. The electrical connector 100, as shown in FIGS. 1 and 12, includes a housing 10, an electrical connection assembly adapted to be inserted into the housing 10, and a locking mechanism 6 mounted on an outer surface of the housing 10 and configured to releasably lock the electrical connector 100 and a mating electrical connector 200 together.

Figure 2:
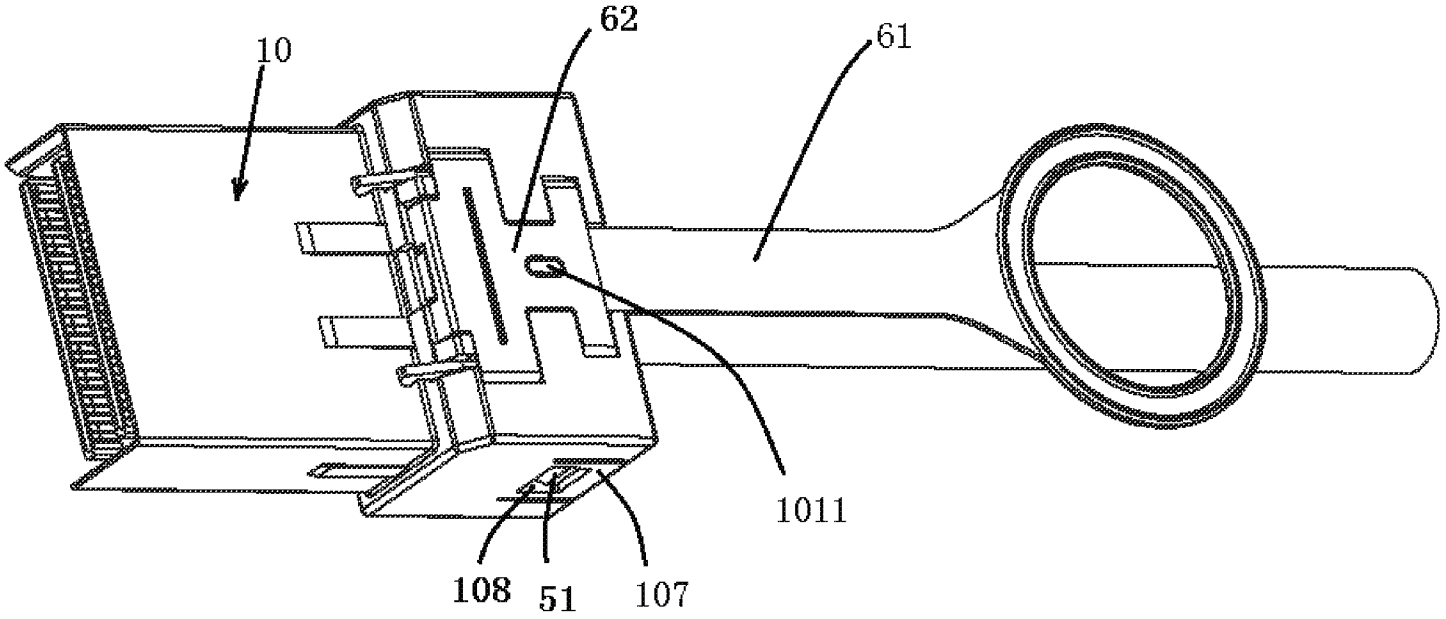
FIG. 2 is a perspective view of the electrical connector of FIG. 1.
Figure 3:
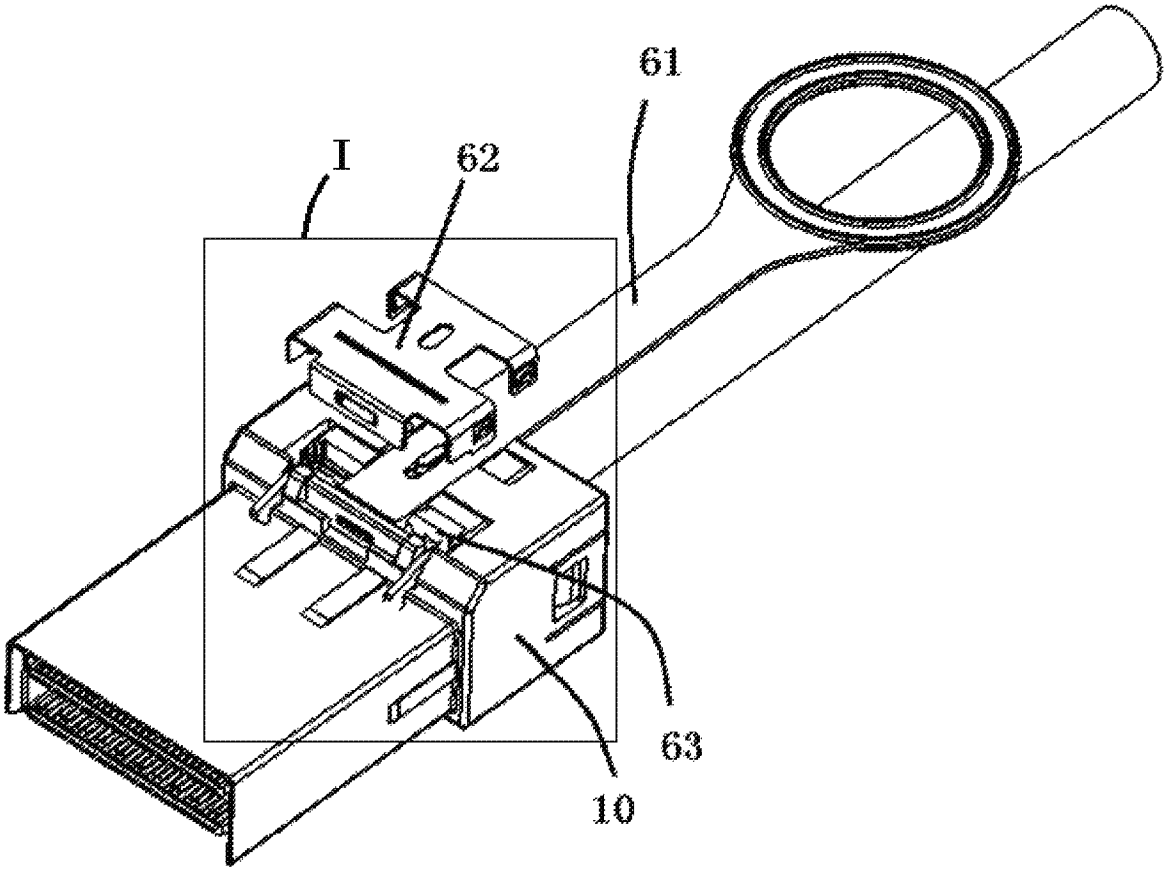
FIG. 3 is a perspective view of the electrical connector of FIG. 1 with a fixing member removed.

The locking mechanism 6, as shown in FIGS. 1-3, includes a handle 61, a locking member 63 adapted to engage with a locking structure on the mating electrical connector 200 and connected to the handle 61 such that the mating electrical connector 200 is unlocked when the handle 61 is pulled, and a fixing member 62 mounted on the outer surface of the housing 10 and adapted to position the locking member 63 and the handle 61 between the fixing member 62 and the housing 10. As shown in FIGS. 2 and 3, the fixing member 62 holds the locking member 63, the handle 61, and an elastic member 64 between the fixing member and the housing 10, so that the housing 10 has a compact structure and a reduced volume.

The electrical connector 100 in the shown embodiment is configured to connect with the mating electrical connector 200. In the shown embodiment, the electrical connector 100 is a plug connector and the mating electrical connector 200 is a receptacle connector. After the electrical connector 100 is inserted into the mating electrical connector 200, the conductive terminals thereof are interconnected, and the locking mechanism 6 fixed on the electrical connector 100 cooperates with a corresponding locking structure on the mating electrical connector 200, thereby locking them and avoiding accidental detachment thereof.

Figure 12:
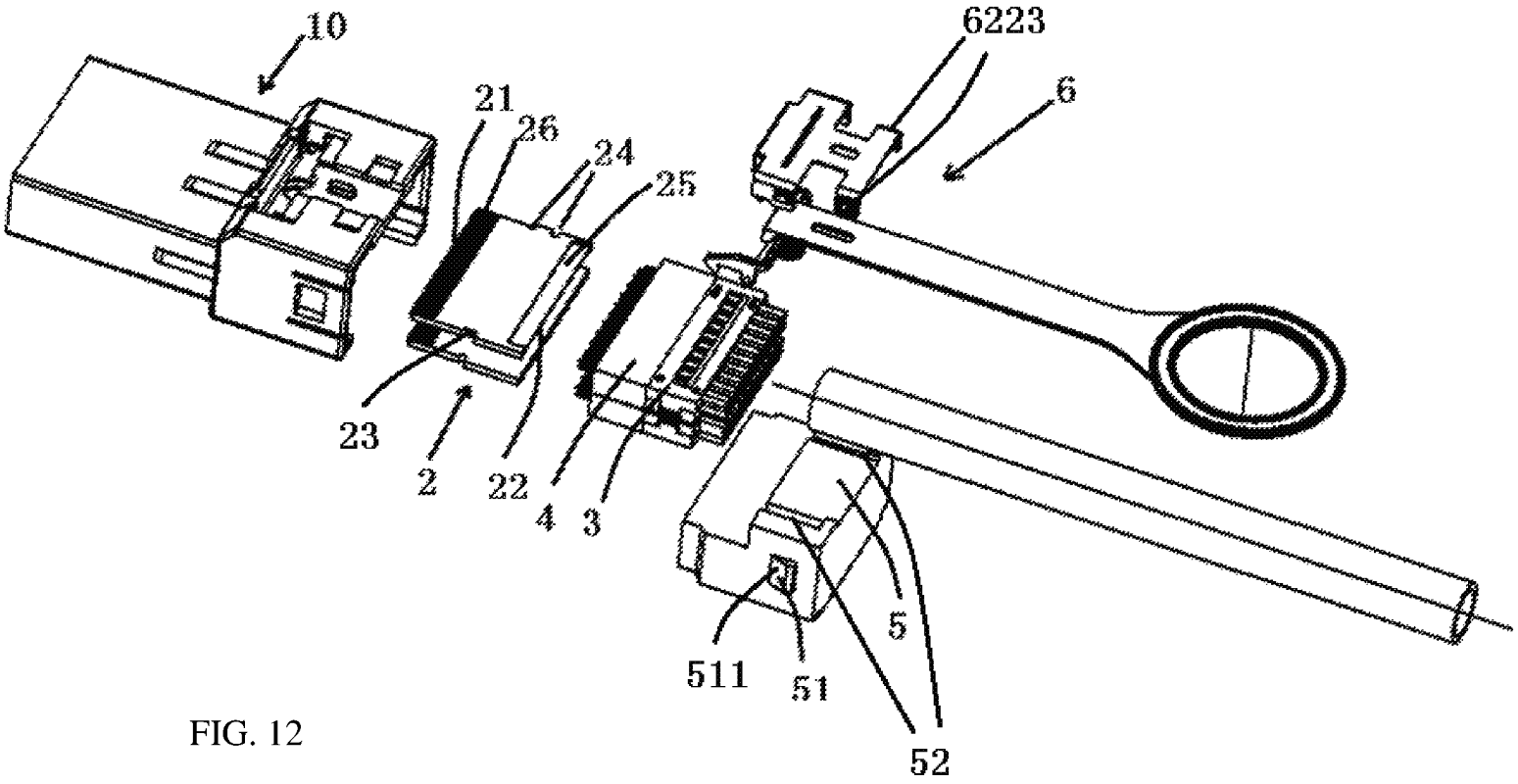
FIG. 12 is an exploded perspective view of the electrical connector.
Figure 13:
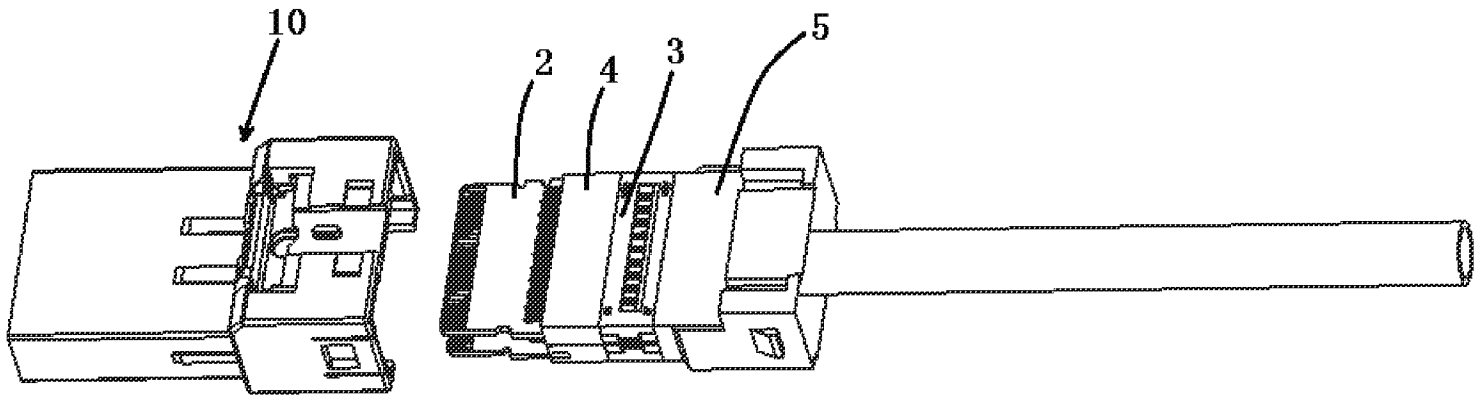
FIG. 13 is a partially exploded perspective view of the electrical connector.

As shown in FIGS. 12 and 13, the electrical connection assembly is adapted to be inserted into the housing 10 and includes a circuit board 2 and a wire clamping component 3. Wires of a cable, on which respective cladding layers are stripped, are clamped by the wire clamping component 3 and are connected to the circuit board 2, so as to realize contact of conductive terminals when the electrical connector 100 is inserted into the mating electrical connector 200.

Figure 4:
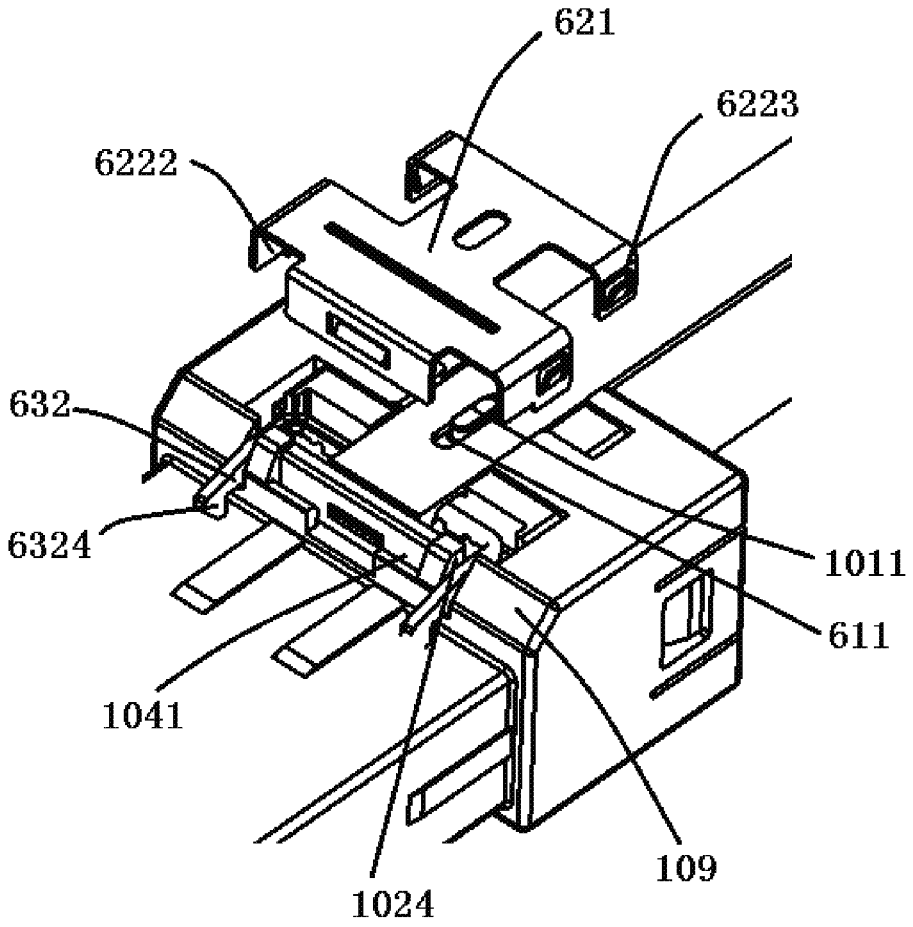
FIG. 4 is a partial enlarged view of a portion I of FIG. 3.
Figure 5:
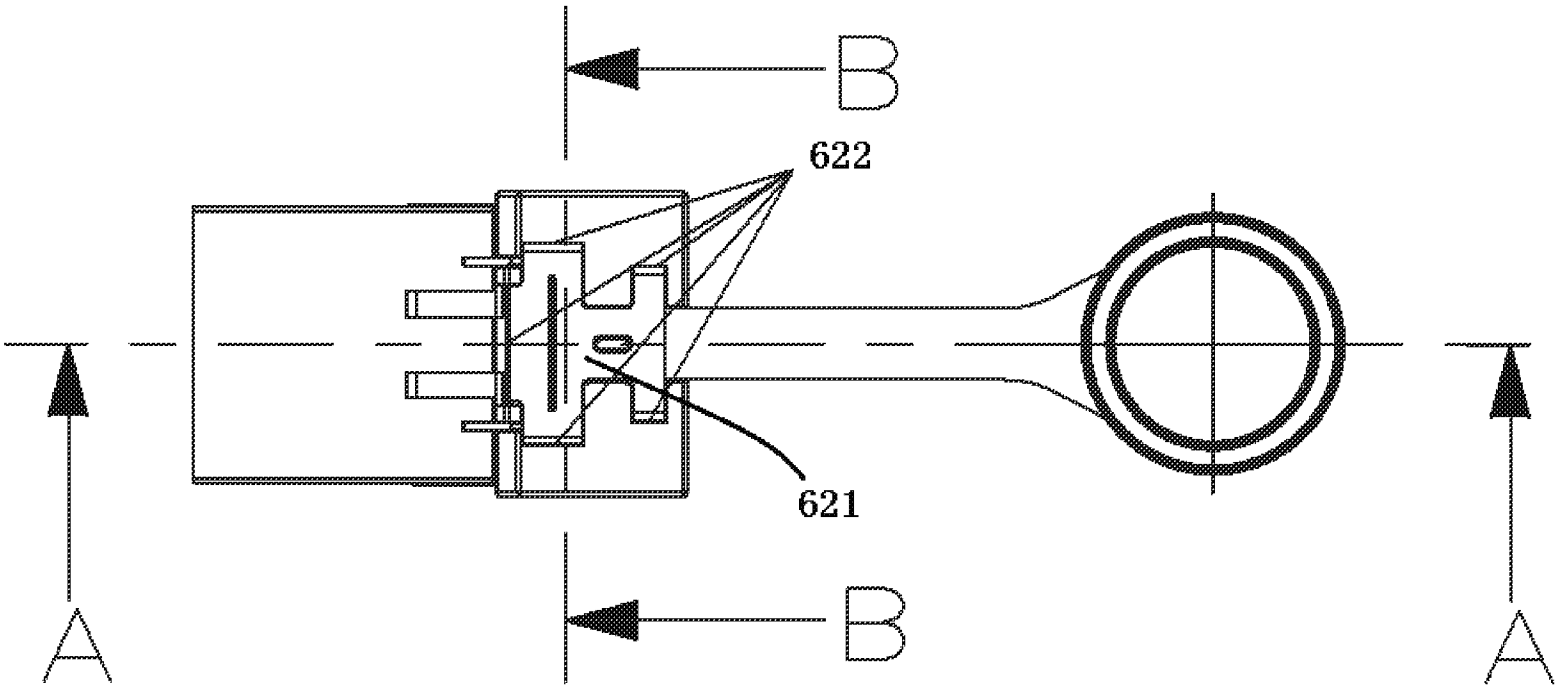
FIG. 5 is a top view of the electrical connector of FIG. 1.
Figure 9:
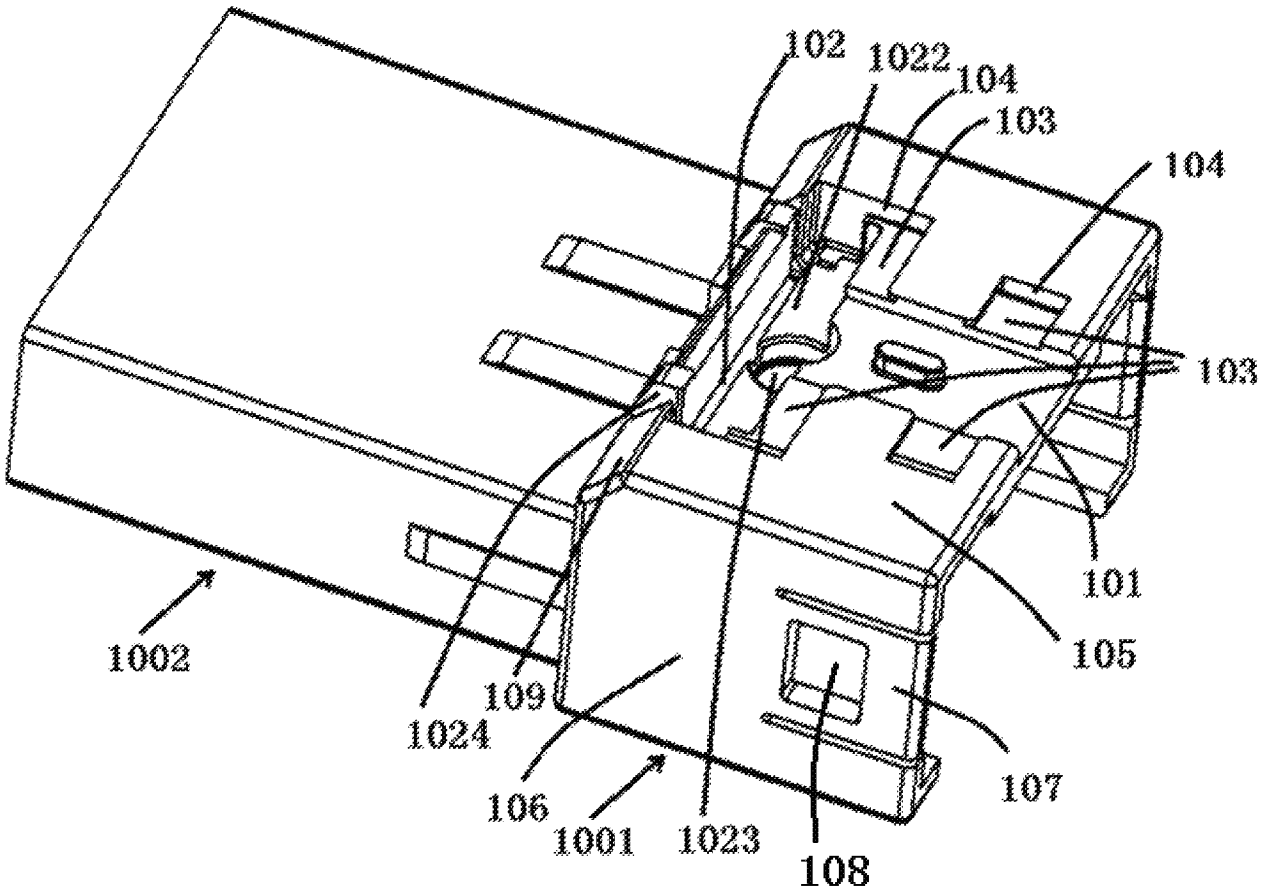
FIG. 9 is a perspective view of a housing of the electrical connector.

The housing 10, as shown in FIG. 9, includes a first body portion 1001 and a second body portion 1002 extending from the first body portion 1001 in a direction toward the mating electrical connector 200. The first body portion 1001 includes a top wall 105 and two side walls 106. As shown in FIGS. 2-4, the locking mechanism 6 is configured to be secured to the outer surface of the top wall 105 of the first body portion 1001. In an embodiment, the housing 10 is formed of a plastic material by molding.

Figure 10:
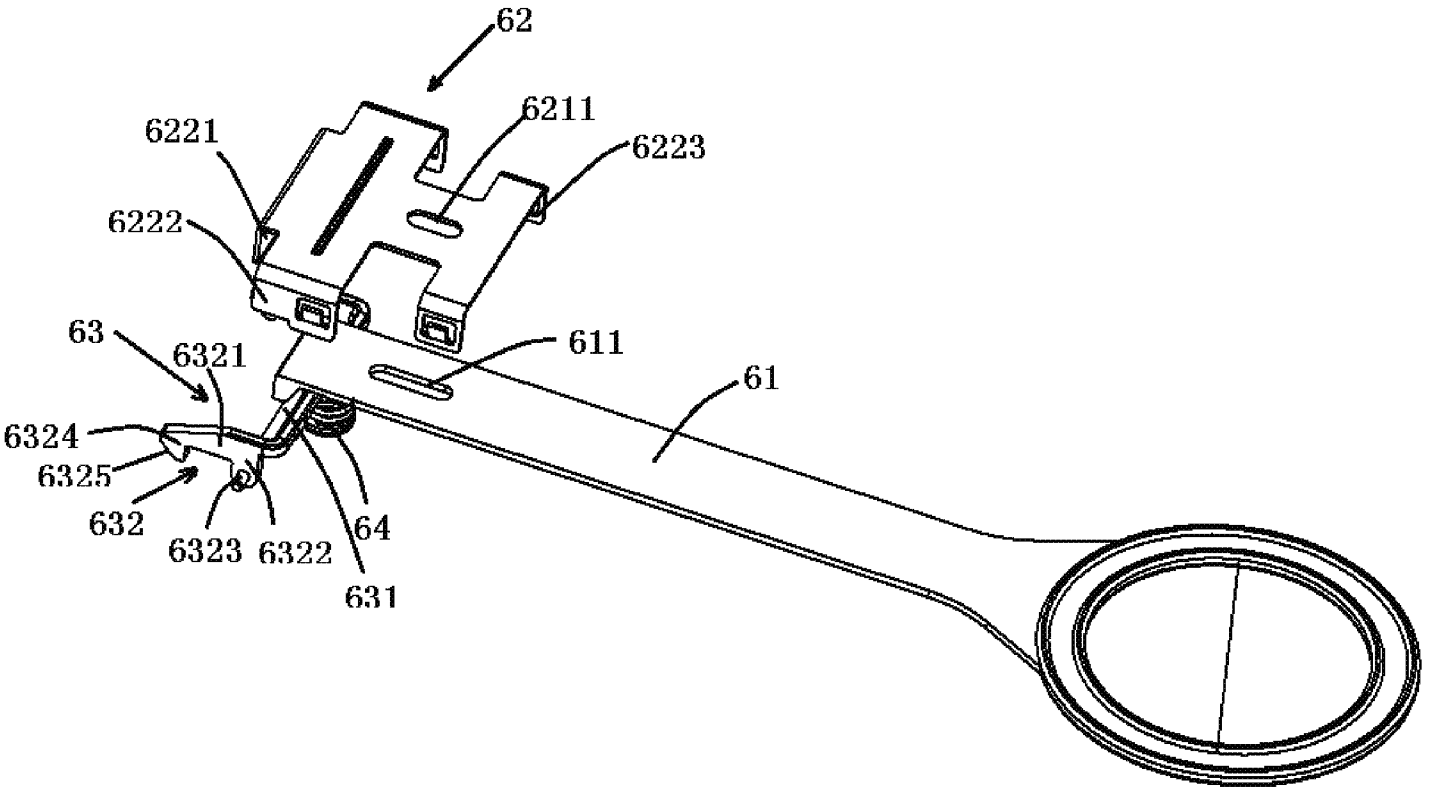
FIG. 10 is a perspective view of a locking mechanism of the electrical connector.
Figure 11:
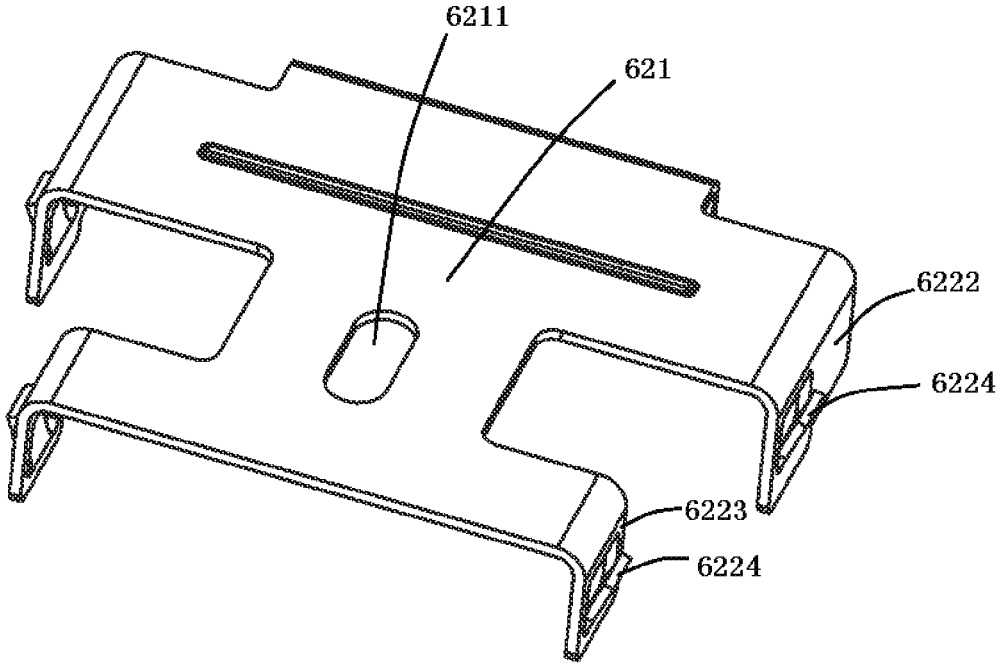
FIG. 11 is a perspective view of a fixing member of the electrical connector.

As shown in FIGS. 11 and 12, the electrical connector 100 further includes a first molded member 5 which is coupled with the housing 10 in a plug-in manner in an extension direction of the cable. The fixing member 62, as shown in FIG. 10, includes a body portion 621, and two first mounting legs 6223 which respectively extend from proximal ends of lateral sides of the body portion 621. The first mounting legs 6223 extend in a direction perpendicular to the body portion and toward an interior of the housing 10 so as to pass through the housing 10 to be secured into the first molded member 5.

As shown in FIG. 12, an upper surface of the first molded member 5 is provided with two slots 52, into which the two first mounting legs 6223 are adapted to be inserted, respectively. As shown in FIGS. 11 and 12, each of the first mounting legs 6223 is formed with a tab 6224 which extends obliquely away from a surface of the first mounting leg 6223 in a direction towards the body portion 621 of the fixing member 62. Meanwhile, a wall of each of the two slots 52 is formed with a groove adapted to connect with the tab 6224 in a snap-fit manner so as to secure the fixing member 62 to the first molded member 5.

As shown in FIG. 9, each side wall 106 of the first body portion 1001 is formed with two slits extending from an end of the side wall 106 proximate to the cable in a longitudinal direction of the housing 10, and between the two slits, an elastic portion 107 is defined to facilitate insertion of the first molded member 5 into the housing 10. The elastic portion 107 has an opening 108. As shown in FIG. 12, a projection 51 is formed on a side wall of the first molded member 5, and the projection 51 includes an inclined surface 511 which extends obliquely towards the side wall 106 of the housing 10. The inclined surface 511 guides the insertion of the first molded member 5 when the first molded member 5 is inserted into the housing 10. The projection 51 is adapted to be snapped into the opening 108.

The fixing member 62, as shown in FIGS. 10-12, further includes two second mounting legs 6222 respectively extending from distal ends of the lateral sides of the body portion 621, and a third mounting leg 6221 extending from one end of the body portion 621 proximate to the mating electrical connector 200 in a direction perpendicular to the longitudinal direction of the housing 10. As shown in FIGS. 5, 7, 8, 10 and 11, each of the second mounting legs 6222 and the third mounting leg 6221 is formed with a tab 6224, which extends obliquely away from a surface of the mounting leg in a direction towards the body portion 621 of the fixing member 62. The tab 6224 is adapted to catch onto a corresponding structure of the first body portion 1001 so as to secure the fixing member 62 to the first body portion 1001.

As shown in FIG. 10, the locking member 63 includes a base 631 extending in a lateral direction of the housing 10. One end of the handle 61 is fixedly connected to a generally middle portion in a lateral direction of the base 631. The locking member 63 further includes two locking arms 632 which respectively extend from two ends of the base 631 in a direction perpendicular to the base 631 and toward the mating electrical connector 200, and two pivot portions which are respectively formed on the two locking arms 632 and configured to pivot the locking arms 632 when pulling the handle 61, thereby achieving unlocking of the mating electrical connector 200. Each pivot portion includes a support portion 6322 extending in a direction from a position of the locking arm body, where the locking arm body is coupled with the base 631, to the interior of the housing 10, and a pivot shaft 6323 disposed on the support portion 6322 and pivotally supported on the housing 10.

The outer surface of the top wall 105 of the housing 10, as shown in FIGS. 3, 4, and 9, is formed with a first groove 102, extending in a lateral direction of the housing 10, at a position proximate to the mating electrical connector 200. The first groove 102 is adapted to receive the base 631 of the locking member 63, a connection portion between the base and the handle 61, and the two pivot portions. The top wall 105 of the housing 10 is formed with a second groove 101, extending in a longitudinal direction of the housing 10, at a position away from the mating electrical connector 200. The second groove 101 is communicated with the first groove 102 and is configured to receive the handle 61.

Figure 7:
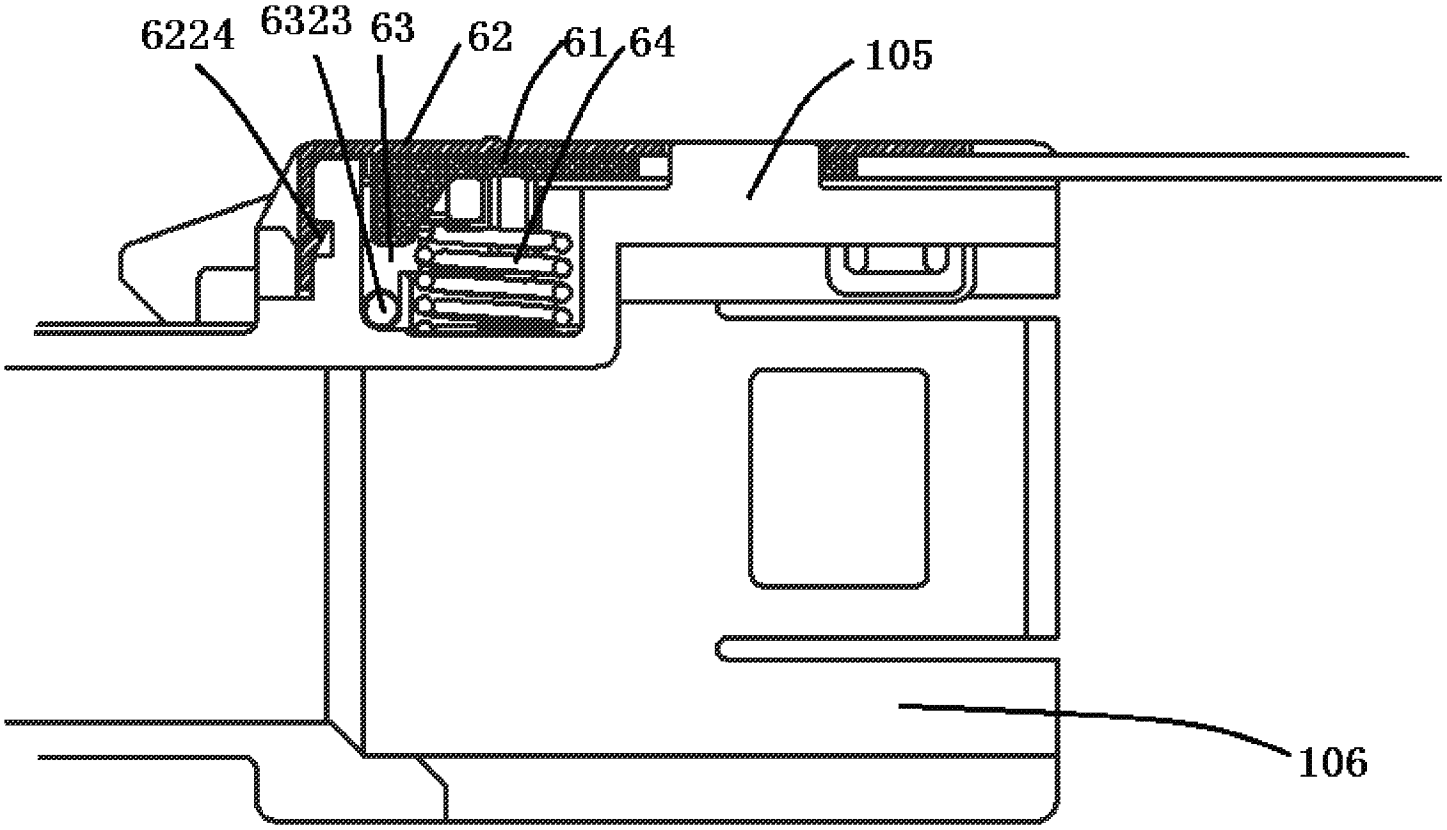
FIG. 7 is a partial enlarged view of a portion C of FIG. 6.
Figure 8:
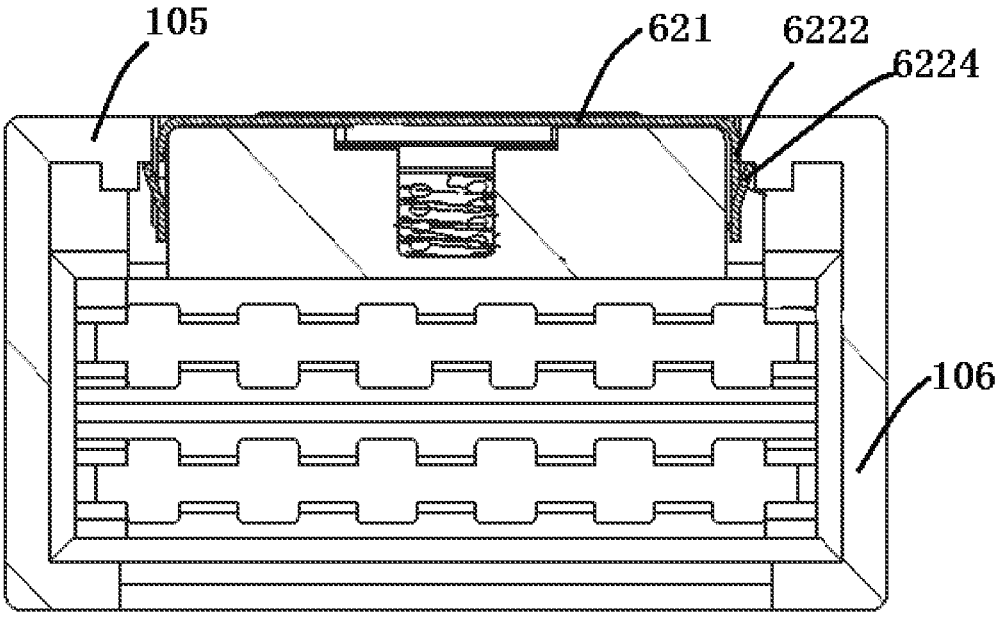
FIG. 8 is a sectional front view of the electrical connector taken along line B-B of FIG. 5.

As shown in FIGS. 7-9, the locking mechanism 6 further includes an elastic member 64 which is coupled with the locking member 63 to bias the locking member 63 so as to achieve locking of the mating electrical connector 200. A boss 1022, extending in a direction from a bottom surface of the first groove 102 toward the exterior of the housing 10, is formed in the first groove 102, and the surface of the boss 1022 is closer to the interior of the housing 10 than a bottom surface of the second groove 101. The boss 1022 is formed with a groove 1023 for receiving the elastic member 64.

Each locking arm 632, as shown in FIG. 10, includes a locking arm body 6321 extending from the base 631 in the direction perpendicular to the base 631 and toward the mating electrical connector 200. Each pivot portion is formed on the locking arm body 6321. Each locking arm 632 further includes a catch portion 6324, which extends from one end of the locking arm body 6321 away from the base 631 in a direction toward the interior of the housing 10. The catch portion 6324 is adapted to engage with a locking structure on the mating electrical connector 200 to maintain the engagement of the connector 100 with the mating connector 200. A groove wall of the first groove 102 proximate to the mating electrical connector 200 is provided with two openings 1024 which pass through the groove wall in the longitudinal direction. The two openings 1024 allow two locking arm bodies 6321 to pass through such that the catch portions 6324 are exposed to the outside of the groove wall.

The mating electrical connector 200, as shown in FIG. 1, includes a frame 2001 and a mating electrical connection assembly secured in the frame 2001. The frame 2001 includes a guide case 2002 proximate to the electrical connector 100. An opening 2003 is formed in a top wall of the guide case 2002.

As shown in FIG. 10, the catch portion 6324 includes an inclined surface 6325 formed on one end of the catch portion 6324 facing toward the mating electrical connector 200, so as to facilitate the insertion of the catch portion 6324 into the locking structure on the frame of the mating electrical connector 200, such as the opening 2003 shown in FIG. 1, thereby enabling the snap engagement of the catch portion 6324 and the opening 2003.

As shown in FIG. 9, a support mechanism formed at one end of the groove 102 is configured to support the pivot shaft 6323 such that the locking member 63 may pivot about the pivot shaft 6323.

As shown in FIGS. 3, 4, 6-9, the top wall 105 of the housing 10 is provided with a third groove 103 for receiving the body portion 621 of the fixing member 62. The top wall 105 of the housing 10 is further provided with four slits 104, which extend in a direction from the third groove 103 towards the interior of the housing 10. The four slits 104 are adapted to receive the two first mounting legs 6223 and the two second mounting legs 6222, respectively. The two first mounting legs 6223 pass through the two slits 104 proximate to the cable to be inserted into the slots 52, while the two second mounting legs 6222 are inserted into the two slots 104 away from the cable. Further, the groove wall of the first groove 102 proximate to the mating electrical connector 200 is provided with a fifth groove 1041 which is adapted to receive the third mounting leg 6221.

As shown in FIG. 4, the groove wall of the first groove 102 includes an inclined surface 109 extending obliquely in a direction from the top surface of the top wall 105 toward the mating electrical connector 200, and the fifth groove 1041 extends in a direction from the inclined surface 109 toward the interior of the housing 10.

As shown in FIGS. 3, 4, 9, and 10, the bottom surface of the second groove 101 is provided with a guiding protrusion 1011 extending in the longitudinal direction of the housing 10. The handle 61 is provided with a sliding slot 611 which is matched with the guiding protrusion 1011. When the handle 61 is moved in the longitudinal direction of the housing 10, the guiding protrusion 1011 is adapted to slide in the sliding slot 611. The body portion 621 of the fixing member 62 is provided with a long groove 6211 configured to match the guiding protrusion 1011 so as to fix the fixing member 62.

Figure 6:
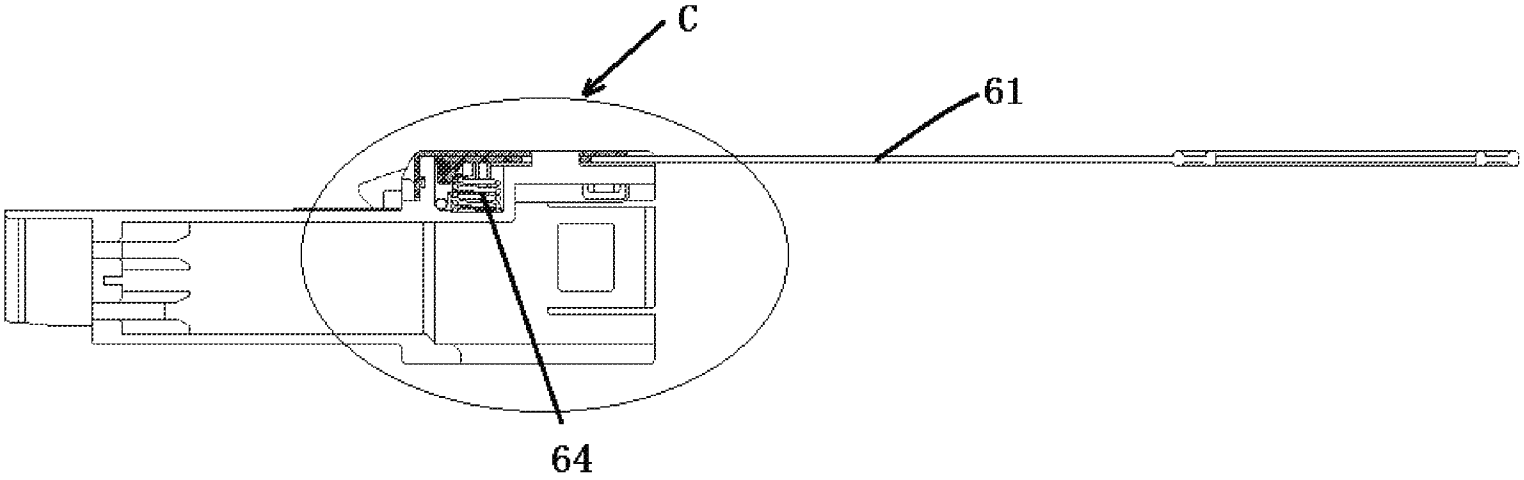
FIG. 6 is a sectional side view of the electrical connector taken along line A-A of FIG. 5.

As shown in FIGS. 1, 6 and 9, the second body portion 1002 of the housing 10 includes a top wall extending from the top wall of the first body portion 1001 and two side walls extending from two side walls of the first body portion 1001. The outer surface of at least one of the top wall and two side walls of the second body portion 1002 is provided with at least one guide 1003, which extends from a connection position between the first body portion 1001 and the second body portion 1002 in a direction towards the mating electrical connector 200. The at least one guide 1003 is configured to guide the insertion when the electrical connector 100 is inserted into the mating electrical connector 200. The at least one guide 1003 is adapted to be in contact with the inner surface of the guide case 2002 to guide the electrical connector 100, such that the electrical connector 100 is accurately inserted to the position of the mating electrical connection assembly. As shown in FIG. 1, the at least one guide 1003 does not extend over the entire longitudinal length of the second body portion 1002.

As shown in FIGS. 4 and 7, a groove wall of the fifth groove 1041 is provided with an opening, into which the tab 6224 may be inserted, and as shown in FIG. 8, slit walls of the slits 104 are also provided with recessed structures. The recessed structures are adapted to allow the tabs of the second mounting legs 6222 and the first mounting legs 6223 to be abutted thereon, so as to fix the third mounting leg 6221, the second mounting legs 6222 and the first mounting legs 6223 all into the grooves on the first body portion 1001 of the housing 10, thereby achieving the fixation of the fixing member 62.

In the embodiment of FIGS. 2-11, when the locking mechanism 6 is assembled to the housing 10, the elastic member 64 is disposed in the groove 1023 and the locking member 63 and the handle 61 connected thereto are disposed in the first groove 102 and the second groove 101. The pivot shaft 6323 of the locking member 63 is disposed in a support mechanism of the housing 10, and the locking arm bodies 6321 are disposed in two openings 1024 such that the catch portions 6324 are exposed to the outside of the groove wall. After that, the third mounting leg 6221, second mounting legs 6222 and first mounting legs 6223 of the fixing member 62 are all inserted into corresponding grooves or slots on the first body portion 1001 of the housing 10. The first mounting legs 6223 pass through the slits 104 on the housing 10 to be inserted into the slots 52 of the first molded member 5 and the tabs 6224 on the mounting legs are secured to the corresponding structures on the groove walls of the slits of the housing 10 and the groove wall of the slots of the first molded member 5, respectively. The fixation for the fixing member 62 is achieved, thereby also achieving positioning of the handle 61, the locking member 63 and the elastic member 64 on the housing. As shown in FIGS. 7 and 10, when the electrical connector 100 is inserted into the mating electrical connector 200, the catch portions 6324 correspondingly enter the openings 2003 of the mating electrical connector 200 to lock the electrical connector 100 to the mating electrical connector 200.

When the handle 61 is pulled away from the electrical connector 100 in the longitudinal direction of the electrical connector 100, the handle 61 moves under the guidance of the guiding protrusion 1011 and the sliding slot 611, to pull the base of the locking member 63 and cause pivoting of the locking arm body 6321 relative to the pivot shaft 6323, such that the catch portions 6324 disengage from the openings 2003 so as to release the locking of the mating electrical connector 200. In this way, the electrical connector 100 and mating electrical connector 200 may be separated from each other.

A gap is provided between the inner surface of the guide case 2002 and the outer surface of the second body portion 1002 of the electrical connector 100 to facilitate initial insertion of the electrical connector 100 into the mating electrical connector 200. When the electrical connector 100 is continuously inserted until the electrical connection assembly 20 is going to be in contact with the mating electrical connection assembly 2004 of the mating electrical connector 200, the guide 1003, formed by protruding from the surface of the top wall and/or the surface of the side walls of the second body portion 1002, comes into contact with the inner surface of the guide case 2002 so as to guide the positions of the electrical connector 100 in the up-down direction and/or lateral direction, such that the electrical connector 100 is accurately inserted into the mating electrical connector 200.

The electrical connector 100 is easily locked onto and unlocked from the mating electrical connector 200, and the structure thereof is simple and compact. Further, the insertion of the electrical connector 100 into mating electrical connector 200 is simple and accurate.

The internal composition of the electrical connector 100 is shown in FIGS. 1-3 and 12-24. In an exemplary embodiment, the cable connected to the electrical connector 100 is a flexible cable including discrete wires, such as 39P. A cladding layer of the flexible cable may be made of nylon mesh, and the flexible cable can be used in a limited space due to its good flexibility.

For such discrete wires, there are the following problems in practical operation: in the case where wires are soldered to two circuit boards, in particular, in the case where the wires are soldered on both upper and lower surfaces of the two circuit boards, it is necessary to organize the discrete wires on which the cladding layer is stripped off so that the wires are substantially straight and soldered to the circuit board. Also, after welded to the circuit board, the wires are bent under the effect of a variety of reasons due to their flexibility, as a result, the wire ends that have been soldered on the conductive terminals of the circuit board are pulled, causing the wires to loosen or peel from the circuit board and resulting in damage to electrical connection performance.

Figure 14:
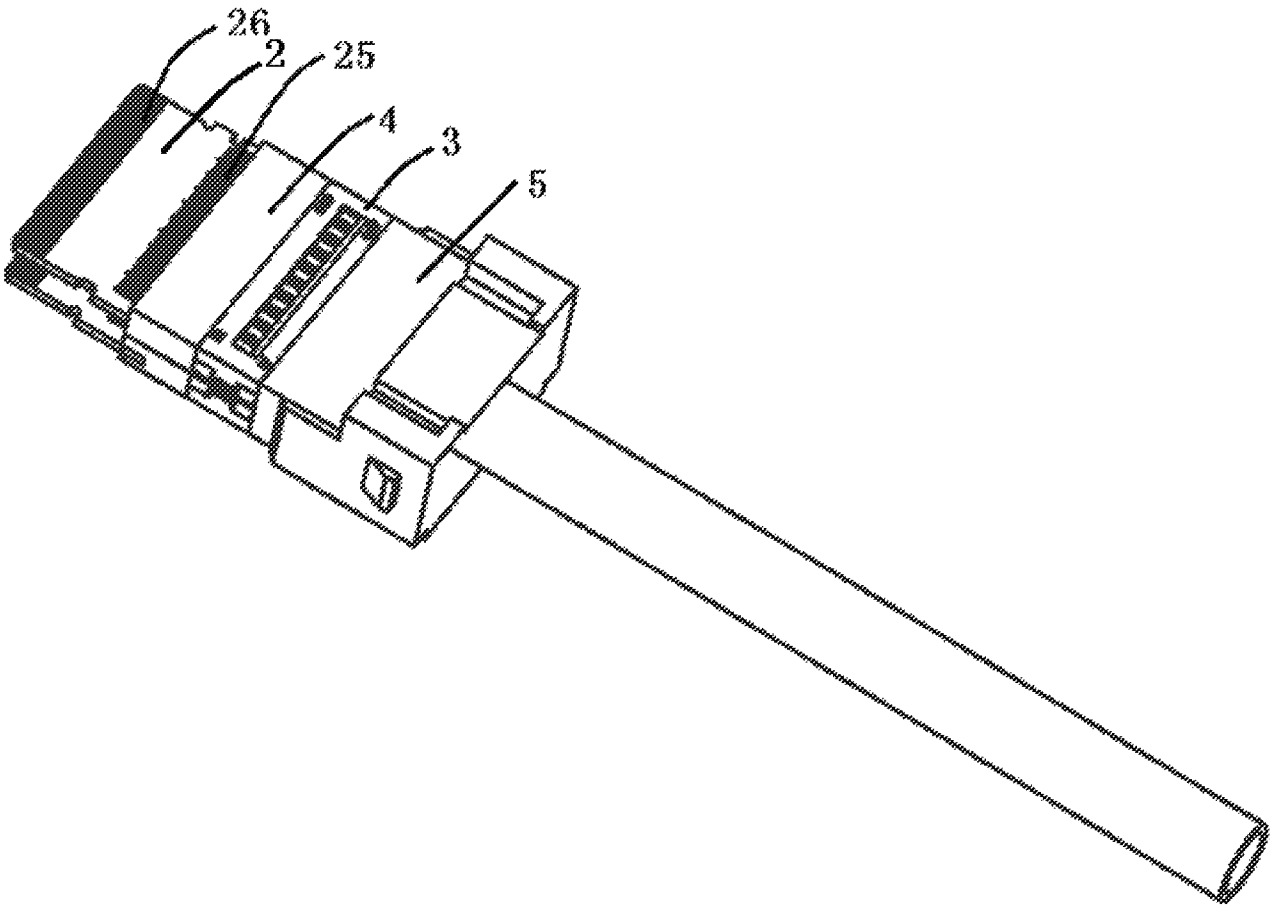
FIG. 14 is a perspective view of an electrical connection assembly according to an embodiment.

As shown in FIGS. 12-14, the electrical connector 100 includes a cable comprising a plurality of wires and cladding layers covering the plurality of wires and an electrical connection assembly electrically connected to the plurality of wires. The electrical connection assembly is adapted to be inserted into the housing 10 and configured to be electrically connected with the mating electrical connector 200. The first molded member 5 is adapted to be inserted into the housing 10 in a plug-in manner in the extending direction of the cable, the first molded member 5 is molded on a portion of the cable in which the cladding layers are not stripped off and at least a portion of the wires on which the cladding layers are stripped off.

The electrical connection assembly, as shown in FIGS. 12-14, includes two circuit boards 2 and a wire clamping component 3 disposed between the two circuit boards 2 and the first molded member 5. The wire clamping component 3 is adapted to clamp a plurality of wires to be soldered to the two circuit boards and without the cladding layers. The first molded member 5 is molded to cover the entire length of the wires between the wire clamping component 3 and the unstripped cladding layers and to cover a portion of the unstripped cladding layers.

The electrical connection assembly, as shown in FIGS. 12-14, further includes a second molded member 4, which is formed between two circuit boards 2 and the wire clamping component 3. Since the wire clamping component 3 is used to clamp a plurality of wires to be soldered to the two circuit boards 2 and without the cladding layers, the wires are organized and held, and the position of the wires to be soldered to the circuit board 2 is fixed. The first molded member 5 formed between the wire clamping component 3 and the unstripped cladding layer and a second molded member 4 formed between the circuit board 2 and the wire clamping component 3 are both used. In an embodiment, the first molded member 5 and the second molded member 4 are formed by an embedded molding process. The wires are embedded in the first molded member 5 and the second molded member 4 to be secured therein, preventing bending and shifting of the wires.

As shown in FIGS. 12-14, each circuit board 2 includes a mating end 21 and a wiring end 22 opposite to the mating end 21. First electrical contacts 26 connected to conductive terminals of the mating electrical connector 200 are provided at a position of the surface of the circuit board 2 near the mating end 21. Second electrical contacts 25 to which the plurality of wires are soldered are provided at a position of the surface of the circuit board 2 near the wiring end 22. As shown in FIG. 13, the second molded member 4 is molded to cover the wiring end 22 of the circuit board 2 and at least a portion of the length of the wire between the circuit board 2 and the wire clamping component 3. The second molded member 4 is molded to further cover at least a portion of the electrical contacts proximate to the wiring end. In an embodiment, the second molded member 4 is molded to cover the entire length of the wire between the circuit board 2 and the wire clamping component 3.

The second molded member 4, as shown in FIGS. 13 and 14, covers the entire length of the wire between the circuit board 2 and the wire clamping component 3 and further covers at least a portion of the second electrical contacts 25 proximate to the wiring end 22. The first molded member 5 is configured to cover the entire length of the wire between the wire clamping component 3 and the unstripped cladding layer and to cover at least a portion of the unstripped cladding layer. Therefore, the flexible wires on which the cladding layers are stripped are all clamped and fixed, producing no bending and shifting. Further, the second electrical contact 25 on the wiring end of the circuit board and a portion of the wires soldered thereto are also embedded in the second molded member 4 so as to completely avoid loosening of the wires soldered to the second electrical contacts 25 of the wiring end of the circuit board 2. Simultaneously, the internal components inserted into the housing 10 are substantially rigid, so as to facilitate insertion and retention thereof into the housing 10, and correspondingly simplify the structure of the housing 10 and reduce the size of the housing 10.

The wire clamping component 3, as shown in FIGS. 12 and 15-24, includes at least one set of dampers, each set of dampers including a first damper 33 and a second damper 34 cooperating with the first damper 33. The first damper 33 and the second damper 34 each are configured to retain a plurality of wires on which the cladding layer are stripped in a row. In the shown embodiment, the wire clamping component 3 includes two sets of clampers to retain the plurality of wires on which the cladding layer are stripped in four rows. The four rows of wires are soldered to the upper and lower surfaces of the two circuit boards 2, respectively.

As shown in FIGS. 16-24, the first damper 33 has a plurality of first positioning holes 331 extending through the body of the first clamper 33, and the second damper 34 is formed with a plurality of second positioning holes 341 extending through the body of the second damper 34. A plurality of wires are adapted to be separated and respectively pass through the first positioning holes 331 and the second positioning holes 341 so as to be retained in the first positioning holes 331 and the second positioning holes 341, respectively.

The body of the first damper 33 is provided with a first coupler 332 and the body of the second clamper 34 is provided with a second coupler 342 which is coupled to the first coupler 332 so as to position the first clamper 33 relative to the second damper 34. The first and second couplers 332, 342 are respectively a protrusion and a groove mating with each other. The first coupler 332 may be a protrusion while the second coupler 342 may be a mating groove, or vice versa. The first damper 33 and the second damper 34 are secured to each other by inserting the protrusion into the groove.

Figure 15:
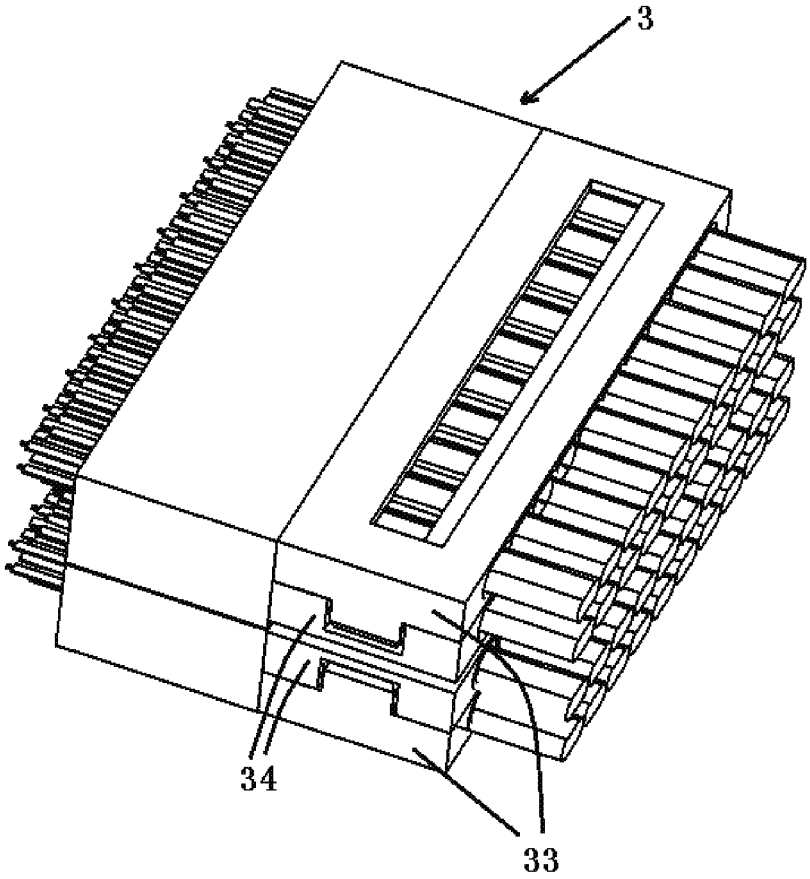
FIG. 15 is a perspective view of a wire clamping component of the electrical connector with a wire clamped in the wire clamping component.
Figure 16:
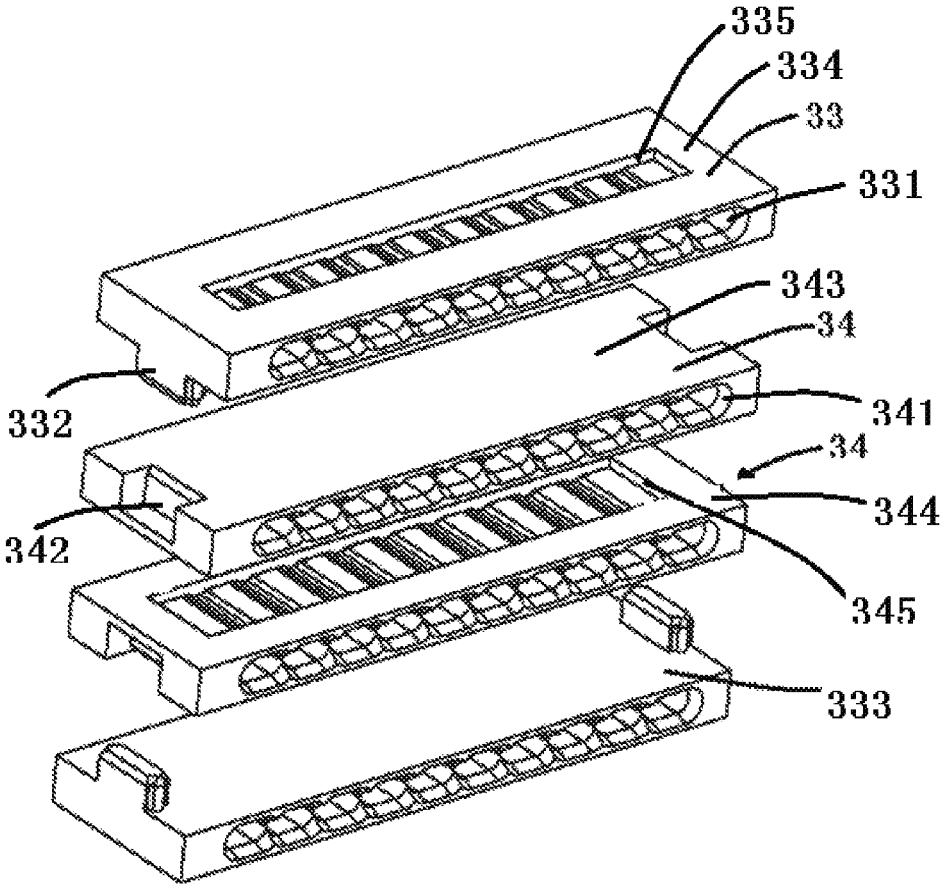
FIG. 16 is an exploded perspective view of the wire clamping component of FIG. 15.
Figure 17:
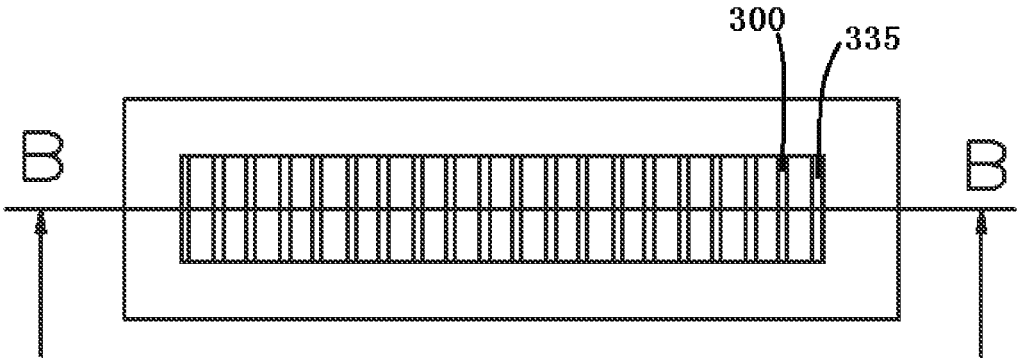
FIG. 17 is a top view of a first damper of the wire clamping component of FIG. 16.
Figure 18:
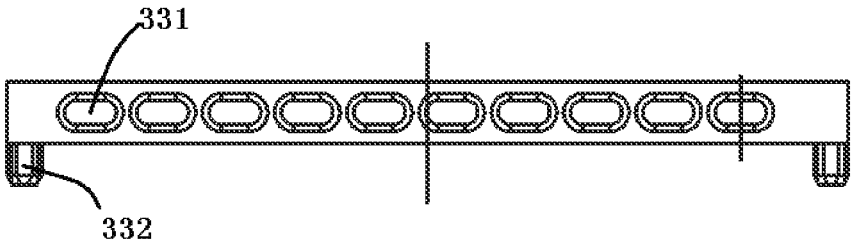
FIG. 18 is a front view of the first damper of FIG. 17.
Figure 19:
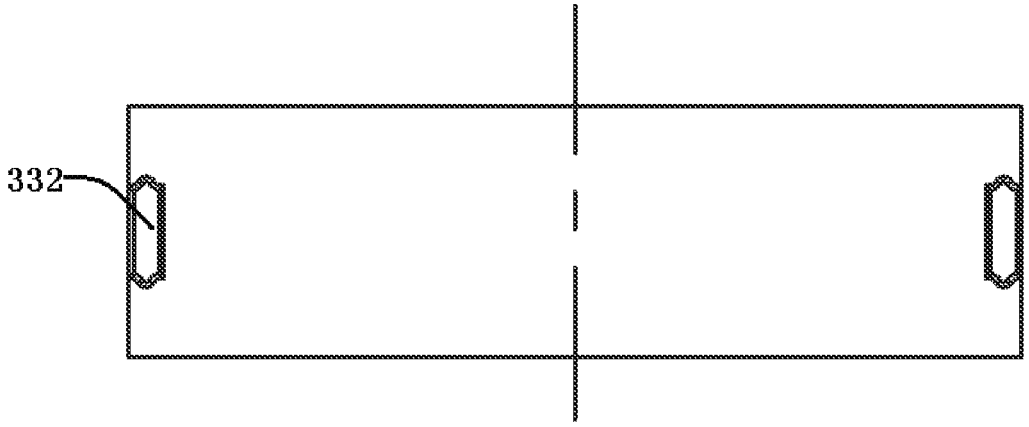
FIG. 19 is a bottom view of the first clamper of FIG. 17.
Figure 20:
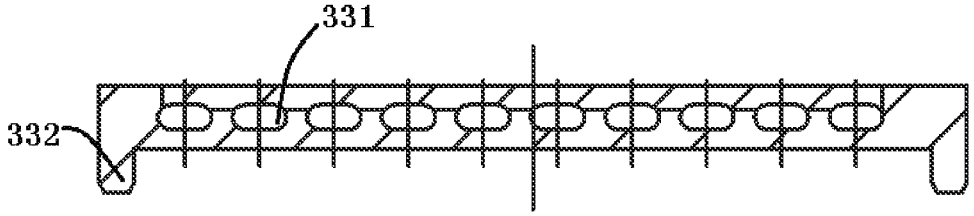
FIG. 20 is a sectional front view of the first damper taken along line B-B of FIG. 17.
Figure 21:
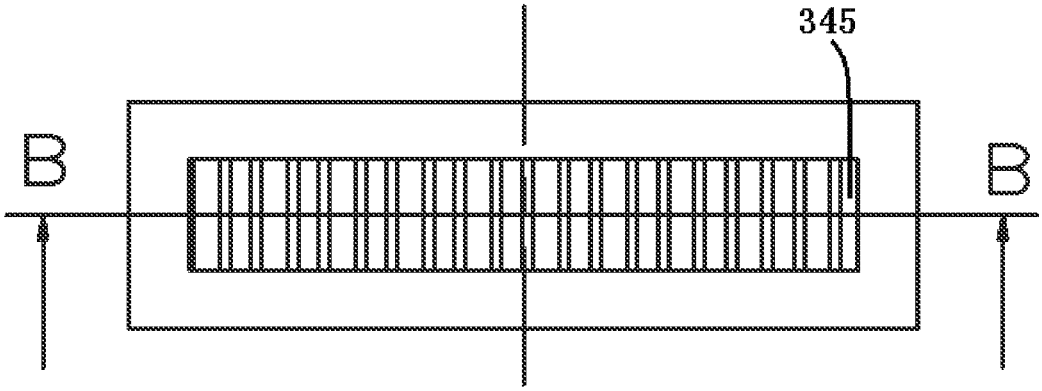
FIG. 21 is a bottom view of a second damper of the wire clamping component of FIG. 16.
Figure 22:
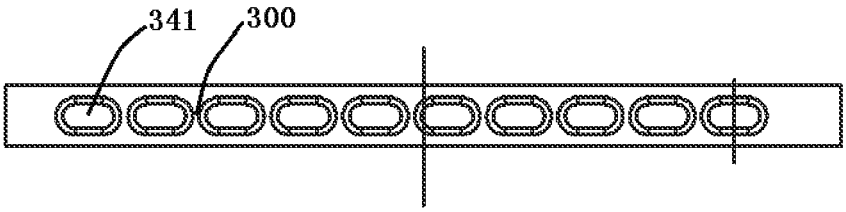
FIG. 22 is a front view of the second damper of FIG. 21.
Figure 23:
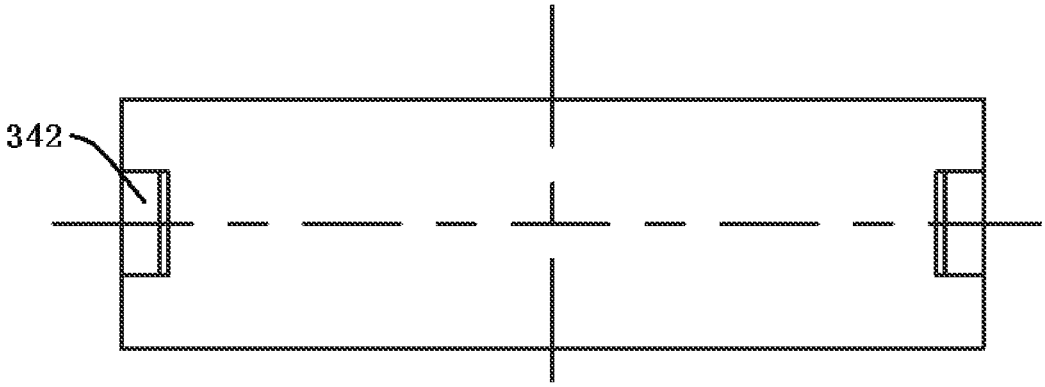
FIG. 23 is a top view of the second damper of FIG. 21.
Figure 24:
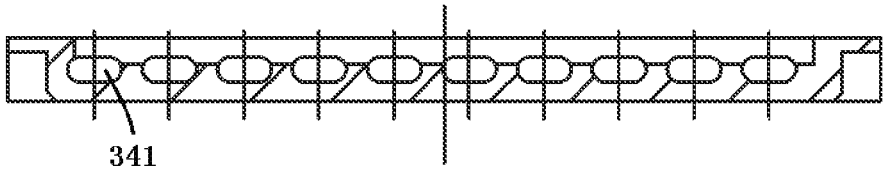
FIG. 24 is a sectional view of the second damper taken along line B-B of FIG. 21.

As shown in FIGS. 15 and 16, the first damper 33 is provided with a first outer surface 333 in contact with the second damper 34 and a second outer surface 334 opposite to the first outer surface 333. The second outer surface 334 is provided with a first opening 335. The first opening 335 extends from the second outer surface 334 to the first positioning holes 331. The second damper 34 is provided with a third outer surface 343 in contact with the first damper 33 and a fourth outer surface 344 opposite to the third outer surface 343. The fourth outer surface 344 is provided with a second opening 345 and the second opening 345 extends from the fourth outer surface 344 to the second positioning holes 341. As shown in FIGS. 15, 18, 20, 22, 24, separation walls 300 are formed between any adjacent first positioning holes 331 and any adjacent second positioning holes 341, respectively, to separate adjacent wires positioned in the adjacent first positioning holes 331 or adjacent second positioning holes 341. By engaging the first and second dampers 33, 34 in each set of dampers together and providing two or more sets of dampers 33, 34 as desired, the wires may be separated into and retained in four or more rows, avoiding interference between different rows of wires and facilitating soldering the wires to the respective conductive terminals arranged on the circuit board in rows.

As shown in FIGS. 12 and 13, the side surface of each circuit board 2 is formed with a groove 23 or 24. The groove 23 or 24 is adapted to mate with a protrusion formed on an inner surface of a side wall 106 of the housing 10 to position the circuit board 2 in the housing 10 when the electrical connection assembly is inserted into the housing 10. A plurality of grooves 23, 24 are formed, wherein the number of grooves 23 formed on the first side of each circuit board 2 is different from the number of grooves 24 formed on the second side of the circuit board 2 opposite to the first side. In this way, it can distinguish the orientation of the internal assemblies to be inserted into the housing 10, avoiding confusion in the direction of the upper and lower surfaces when inserting the inner assemblies into the housing.

A method of forming the electrical connector 100 adapted to electrically connect with the mating electrical connector 200 includes:

providing two circuit boards 2 and a cable, the cable including a plurality of wires and cladding layers covering the plurality of wires;

providing a wire clamping component 3 adapted to clamp the plurality of wires which are to be soldered to the two circuit boards and on which the cladding layers are stripped;

soldering the plurality of wires clamped by the wire clamping component 3 to the two circuit boards 2, respectively;

forming a first molded member 5 on a portion of the cable in which the cladding layers are not stripped and at least a portion of the wires on which the cladding layers are stripped, and forming a second molded member 4 between the circuit boards 2 and the wire clamping component 3; and inserting the two circuit boards, the second molded member, the wire clamping member, the first molded member and the cable connected together as a whole into the housing 10 to form the electrical connector 100.

In an embodiment, the first molded member 5 and the second molded member 4 are formed by an embedded molding process.

In the electrical connector 100 and method of forming the electrical connector 100 described above according to various embodiments of the present disclosure, the electrical connector 100 is connected with mating electrical connector 200 by the locking structures, facilitating locking and unlocking with mating electrical connector 200. By inserting the fixing member 62 through the housing 10 into the first molded member 5 inside the housing 10, the secure positioning for the locking mechanism 6 may be achieved such that the electrical connector 100 has a simple and compact structure while achieving accurate, convenient insertion of the electrical connector 100 into the mating electrical connector 200. Meanwhile, by clamping the wires with the wire clamping component 3 and by fixing the circuit board 2, the wires and the cable with the molded members 4, 5 on both sides of the wire clamping component 3, the electrical connector 100 has good clamping of the wires and ensures reliable electrical connection and enables fixing of the electrical connection assembly in the housing 10, simplifying the structure of the housing 10 and reducing cost. Furthermore, by using the wire clamping component 3, interference between wires in different rows may be avoided, such that the wires are conveniently welded to the respective conductive terminals arranged on the circuit board 2 in rows, and the wire clamping component 3 is not required to be removed after welding the wires to the circuit board 2, thereby simplifying the operation.

What is claimed is:

1. An electrical connector comprising:

a housing including a first body portion and a second body portion extending from the first body portion in a direction toward a mating electrical connector, the first body portion includes a top wall and a pair of side walls, each side wall of the first body portion has a pair of slits extending from an end of the side wall proximate to a cable in a longitudinal direction of the housing, an elastic portion is defined between the slits to facilitate insertion of a first molded member into the housing;

an electrical connection assembly received in the housing; and a locking mechanism mounted on an outer surface of the housing and configured to releasably lock the electrical connector and the mating electrical connector together, the locking mechanism is secured to an outer surface of the top wall of the first body portion, the locking mechanism including:

a handle;

a locking member adapted to be engaged with a locking structure on the mating electrical connector, the locking member connected to the handle such that the mating electrical connector is unlocked when the handle is pulled; and a fixing member mounted on the outer surface of the housing and adapted to position the locking member and the handle between the fixing member and the housing.

2. The electrical connector of claim 1, wherein the elastic portion has an opening, a side surface of the first molded member has a projection extending therefrom and adapted to be snapped into the opening, and the projection has an inclined surface extending obliquely in an insertion direction of the first molded member.

3. The electrical connector of claim 1, wherein the locking member includes:

a base extending in a lateral direction of the housing, an end of the handle is fixedly connected to a generally middle portion in a lateral direction of the base;

a pair of locking arms extending from a pair of opposite ends of the base in a direction perpendicular to the base and toward the mating electrical connector; and a pair of pivot portions formed on the locking arms and configured to allow the pivoting of the locking arms when pulling the handle to unlock the mating electrical connector.

4. The electrical connector of claim 3, wherein each locking arm includes:

a locking arm body extending from the base in the direction perpendicular to the base and toward the mating electrical connector, the pivot portion is formed on the locking arm body; and a catch portion extending from an end of the locking arm body away from the base in a direction toward the interior of the housing and adapted to engage with the locking structure on the mating electrical connector.

5. The electrical connector of claim 4, wherein each pivot portion includes:

a support portion extending from the locking arm body near a location where the locking arm body is coupled with the base in a direction towards the interior of the housing; and a pivot shaft disposed on the support portion and pivotally supported on the housing.

6. The electrical connector of claim 4, wherein a first groove extending in a lateral direction of the housing is formed in a top wall of the housing at a position proximate to the mating electrical connector, and the first groove is adapted to receive the base of the locking member, a connection portion between the base and the handle, and the pivot portions.

7. The electrical connector of claim 6, wherein a second groove extending in a longitudinal direction of the housing is formed in the top wall of the housing at a position away from the mating electrical connector, the second groove communicates with the first groove and is configured to receive the handle.

8. The electrical connector of claim 7, wherein the locking mechanism includes an elastic member adapted to bias the locking member and a boss formed in the first groove and extending in a direction from a bottom surface of the first groove toward the exterior of the housing, a surface of the boss being closer to the interior of the housing than a bottom surface of the second groove, the boss is formed with a groove for receiving the elastic member and a groove wall of the first groove proximate to the mating electrical connector has a pair of openings extending through the groove wall, with locking arm bodies extending through the openings such that the catch portions are exposed to the outside of the groove wall.

9. The electrical connector of claim 7, wherein the bottom surface of the second groove has a guiding protrusion extending in the longitudinal direction of the housing and the handle has a sliding slot matched with the guiding protrusion, the guiding protrusion is adapted to slide in the sliding slot when the handle is moved in the longitudinal direction of the housing, and a body portion of the fixing member has a long groove configured to match with the guiding protrusion so as to fix the fixing member.

10. The electrical connector of claim 1, wherein the second body portion of the housing includes a top wall extending from the top wall of the first body portion and a pair of side walls extending from the side walls of the first body portion, an outer surface of at least one of the top wall and the side walls of the second body portion has at least one guide extending from a connection position between the first body portion and the second body portion in a direction towards the mating electrical connector and configured to guide the insertion of the electrical connector into the mating electrical connector.

11. The electrical connector of claim 10, wherein the mating electrical connector includes a frame and a mating electrical connection assembly secured in the frame, the frame has a guide case proximate to the electrical connector, and the at least one guide is adapted to be in contact with an inner surface of the guide case such that the electrical connector is accurately inserted to a position of the mating electrical connection assembly, and the at least one guide does not extend over the entire longitudinal length of the second body portion.

12. An electrical connector comprising:

a housing;

an electrical connection assembly received in the housing;

a locking mechanism:

(a) mounted on an outer surface of the housing, (b) configured to releasably lock the electrical connector and a mating electrical connector together, and (c) including:

(1) a handle, (2) a locking member adapted to be engaged with a locking structure on the mating electrical connector and connected to the handle such that the mating electrical connector is unlocked when the handle is pulled, (3) a fixing member:

(i) mounted on the outer surface of the housing, (ii) adapted to position the locking member and the handle between the fixing member and the housing, and (iii) having:

a body portion, and a pair of first mounting legs extending from proximal ends of a pair of lateral sides of the body portion in a direction perpendicular to the body portion and toward an interior of the housing so as to pass through the housing to be secured into the first molded member; and a first molded member coupled with the housing in a plug-in manner in an extension direction of a cable.

13. The electrical connector of claim 12, wherein an upper surface of the first molded member has a pair of slots and the first mounting legs are adapted to be inserted into the slots.

14. The electrical connector of claim 13, wherein each of the first mounting legs has a tab extending obliquely away from a surface of the first mounting leg, and a slot wall of each of the slots has a groove adapted to mate with the tab in a snap-fit manner so as to secure the fixing member to the first molded member.

15. The electrical connector of claim 14, wherein a top wall of the housing has a third groove receiving the body portion of the fixing member and a plurality of slits extending in a direction from the third groove towards the interior of the housing, the first mounting legs passing through a pair of the slits proximate to the cable to be inserted into the slots and the second mounting legs being inserted into a pair of the slits away from the cable, a groove wall of the first groove proximate to the mating electrical connector has a fifth groove adapted to receive the third mounting leg.

16. The electrical connector of claim 15, wherein an inclined surface extending obliquely in a direction from the top surface of the top wall toward the mating electrical connector is formed on the groove wall of the first groove, and the fifth groove extends in a direction from the inclined surface toward the interior of the housing.

17. The electrical connector of claim 12, wherein the fixing member includes a pair of second mounting legs extending from distal ends of the lateral sides of the body portion, and a third mounting leg extending from an end of the body portion proximate to the mating electrical connector in a direction perpendicular to a longitudinal direction of the housing.

18. The electrical connector of claim 17, wherein each of the second mounting legs and the third mounting leg has a tab, the tab extending obliquely away from a surface of the second mounting leg or the third mounting leg in a direction towards the body portion of the fixing member and being adapted to catch onto a corresponding structure of a first body portion of the housing so as to secure the fixing member to the first body portion.

* * * * *